US010738399B2

(12) United States Patent
Schwarzberger

(10) Patent No.: US 10,738,399 B2
(45) Date of Patent: Aug. 11, 2020

(54) METHOD, APPARATUS AND COMPUTER-READABLE MEDIUM FOR MOVING

(71) Applicant: ABM International, Inc., The Woodlands, TX (US)

(72) Inventor: Neal A. Schwarzberger, The Woodlands, TX (US)

(73) Assignee: ABM International, Inc., The Woodlands, TX (US)

( * ) Notice: Subject to any disclaimer, the term of this patent is extended or adjusted under 35 U.S.C. 154(b) by 0 days.

(21) Appl. No.: 16/123,537

(22) Filed: Sep. 6, 2018

(65) Prior Publication Data

US 2019/0010643 A1 Jan. 10, 2019

Related U.S. Application Data

(63) Continuation of application No. 15/069,722, filed on Mar. 14, 2016, now Pat. No. 10,094,055.

(51) Int. Cl.
*D05B 19/12* (2006.01)
*D05B 11/00* (2006.01)

(52) U.S. Cl.
CPC ..... *D05B 19/12* (2013.01); *D05B 11/00* (2013.01)

(58) Field of Classification Search
CPC ..... D05B 19/12; D05B 19/14; D05B 19/16
USPC ..... 700/139–138
See application file for complete search history.

(56) References Cited

U.S. PATENT DOCUMENTS 3,573,581 A * 4/1971 Dutko ..... D05B 69/22 318/266
4,235,437 A * 11/1980 Ruis ..... A63B 21/00178 482/113
4,628,910 A * 12/1986 Krukowski ..... A63B 21/0058 482/5
4,647,039 A * 3/1987 Noffsinger ..... A63B 21/0058 482/130
4,746,113 A * 5/1988 Kissel ..... A63B 21/0628 482/5
4,785,674 A * 11/1988 Orman ..... A63B 21/005 482/8
4,921,244 A * 5/1990 Berroth ..... A63B 21/00 340/665
5,015,926 A * 5/1991 Casler ..... A63B 21/0058 318/9
5,242,339 A * 9/1993 Thornton ..... A63B 22/02 482/54
5,368,532 A * 11/1994 Farnet ..... A63B 22/02 482/5
5,421,798 A * 6/1995 Bond ..... A63B 23/03533 482/1
5,569,121 A * 10/1996 Sellier ..... A63B 21/0058 318/806

(Continued)

*Primary Examiner* — Danny Worrell
(74) *Attorney, Agent, or Firm* — Timothy W. Menasco, Esq.; Harter Secrest & Emery LLP

(57) ABSTRACT

Presented is a method, apparatus, and computer-readable medium for moving. A method includes sensing a change in a torque on a motor operably connected to a sewing head for at least partially assisting movement of the sewing head relative to a workpiece. The method further includes adjusting an output of the motor to change at least one of a direction and a speed of movement of the sewing head in response to the sensed change in the torque.

13 Claims, 5 Drawing Sheets

(56) References Cited

U.S. PATENT DOCUMENTS 5,660,129 A * 8/1997 Murata ..... D05B 19/12 112/220
5,707,319 A * 1/1998 Riley ..... A63B 22/001 482/54
5,832,849 A * 11/1998 Kaetterhenry ..... D05B 11/00 112/117
6,027,429 A * 2/2000 Daniels ..... A63B 21/0056 482/111
6,066,074 A * 5/2000 Marcinkiewicz .. A63B 21/0053 482/4
6,170,414 B1 * 1/2001 Kaetterhenry ..... D05B 11/00 112/102.5
6,178,903 B1 * 1/2001 Bondanza ..... D05B 1/10 112/117
6,413,195 B1 * 7/2002 Barzelay ..... A63B 21/00178 482/112
6,416,444 B1 * 7/2002 Lim ..... A63B 24/00 482/51
6,632,159 B1 * 10/2003 Slattery ..... A63B 21/078 482/4
7,191,718 B1 * 3/2007 Myers ..... D05B 11/00 112/117
7,618,346 B2 * 11/2009 Crawford ..... A63B 21/0059 482/51
7,682,287 B1 * 3/2010 Hsieh ..... A63B 21/00196 482/1
8,187,152 B2 * 5/2012 Gravel ..... A61H 1/0274 482/1
8,287,434 B2 * 10/2012 Zavadsky ..... A63B 21/00 482/5
8,297,211 B2 * 10/2012 Stokes ..... D05B 11/00 112/102.5
8,360,935 B2 * 1/2013 Olsen ..... A63B 21/0058 482/1
8,403,816 B2 * 3/2013 Park ..... A63B 21/0053 482/54
8,480,541 B1 * 7/2013 Brunts ..... A63B 22/0242 482/1
8,608,622 B2 * 12/2013 Alberts ..... A61H 1/02 482/1
8,794,167 B2 * 8/2014 Takizawa ..... D05B 47/04 112/242
9,016,218 B2 * 4/2015 Fujiura ..... D05B 19/12 112/102.5
2002/0104468 A1 * 8/2002 Myers ..... D05B 11/00 112/117
2007/0202992 A1 * 8/2007 Grasshoff ..... A63B 21/0058 482/8
2009/0036272 A1 * 2/2009 Yoo ..... A63B 22/0257 482/7
2009/0215588 A1 * 8/2009 Riener ..... A61H 1/0237 482/7
2010/0210419 A1 * 8/2010 Park ..... A63B 21/0053 482/7
2011/0172058 A1 * 7/2011 Deaconu ..... A63B 22/0012 482/5
2011/0195819 A1 * 8/2011 Shaw ..... A63B 24/0062 482/5
2013/0065730 A1 * 3/2013 Camerota ..... A63B 21/0058 482/5
2014/0109814 A1 * 4/2014 Fujiura ..... D05B 19/12 112/102.5

* cited by examiner

METHOD, APPARATUS AND COMPUTER-READABLE MEDIUM FOR MOVING

BACKGROUND OF THE DISCLOSURE

Field of the Disclosure

The present disclosure provides a method, apparatus, and computer-readable medium for moving. More particularly, embodiments of the present disclosure provide a quilting machine for torque sensing.

Description of Related Art

Machine quilting is quilting made using a sewing machine to stitch in rows or patterns using select techniques to stitch through layers of fabric and batting in the manner of old-style hand-quilting. Free motion quilting is a process used to stitch the layers of a quilt together using a domestic sewing machine. The operator controls the stitch length as well as the direction of the stitching line by moving the quilt with their hands or by moving the sewing head while maintaining the work piece stationary. The stitching can be made in any direction and to for curvilinear lines or straight patterns. Each design, whether drawn on the quilt top or held in the imagination of the quilter, is formed with a line of stitching that is guided by the movement of the quilt under the machine needle, or movement of the machine needle with a stationary quilt.

Longarm quilting is the process by which a longarm sewing machine is used to sew together a quilt top, quilt batting and quilt backing into a finished quilt. Quilting using a longarm machine can take significantly less time than hand quilting or more traditional machine quilting. However, for both, the continued movement of the sewing machine relative to the work piece can unnecessarily tire an operator.

BRIEF SUMMARY OF THE DISCLOSURE

In view of the foregoing, it is an object of the present disclosure to provide a method, apparatus, and computer-readable medium for moving.

A first exemplary embodiment of the present disclosure provides a method. The method includes sensing a change in a torque on a motor operably connected to a sewing head for at least partially assisting movement of the sewing head relative to a workpiece, wherein the motor selectively moves the sewing head over a workpiece and the change in torque is sensed by a torque sensor operably coupled to the motor. The method further includes adjusting an output of the motor to change at least one of a direction and a speed of movement of the sewing head in response to the sensed change in the torque.

A second exemplary embodiment of the present disclosure provides an apparatus. The apparatus includes a sewing head including a reciprocating needle, and a motor operably connected to the sewing head, the motor able to move the sewing head relative to a workpiece. The apparatus further includes a torque sensor operably coupled to the motor, the torque sensor able to sense a torque on the motor from the sewing head, and a controller operably coupled to the torque sensor and the motor, the controller able to control a speed of the motor in response to the sensed torque on the motor.

A third exemplary embodiment of the present disclosure provides an apparatus. The apparatus includes a sewing head, a motor operably connected to the sewing head, a torque sensor operably coupled to the motor, and a controller operably coupled to the torque sensor and the motor, wherein the sewing head, the motor, the torque sensor, and the controller are configured to at least sense a change in a torque on the motor from a sewing head, the change in torque sensed by the torque sensor operably coupled to the motor, the motor operably connected to the sewing head to move the sewing head over a workpiece. The apparatus further configured to adjust at least one of a direction and a speed of movement of the sewing head in response to the sensed change in the torque on the motor from the sewing head, wherein the speed and direction of movement of the sewing head is controlled by a controller operably coupled to the torque sensor and the motor.

A fourth exemplary embodiment of the present disclosure provides a non-transitory computer-readable medium tangibly comprising computer program instructions which when executed on a processor of an apparatus causes the apparatus to at least sensing a change in a torque on a motor operably connected to a sewing head for at least partially assisting movement of the sewing head relative to a workpiece, wherein the motor selectively moves the sewing head over a workpiece and the change in torque is sensed by a torque sensor operably coupled to the motor. The computer-readable medium tangibly comprising computer program instructions when executed on the processor further cause the apparatus to adjusting an output of the motor to change at least one of a direction and a speed of movement of the sewing head in response to the sensed change in the torque.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE DISCLOSURE

In free motion quilting, the user determines the location and movement of the needle relative to a work piece. In one instance, the user can move the sewing head of the quilting machine over a stationary work piece in whichever direction the user desires to create a pattern or sewn pattern in the work piece, such as a quilt. In another instance, the user can move the work piece below a stationary sewing head of the quilting machine to create a desired quilt. In yet another instance, the user can move both the sewing head of the quilting machine and the work piece to create the desired quilt.

However, a user may have difficulties moving or operating a sewing head of a quilting machine due to the physical limitations of the user and/or due to the quilting machine size, location, or weight, or a combination of all of the above reasons. This difficulty may occur when a user initiates stitching on the quilting machine or when a user wants to change the direction and/or speed of the stitching.

Exemplary embodiments in accordance with the present disclosure include a method, apparatus and computer-readable medium that enables a user to more easily free motion quilt. Exemplary embodiments of the present disclosure allow a motor to assist in movement of a sewing head of a quilting machine in response to user applied torque to the motor via the sewing head.

Figure 1:
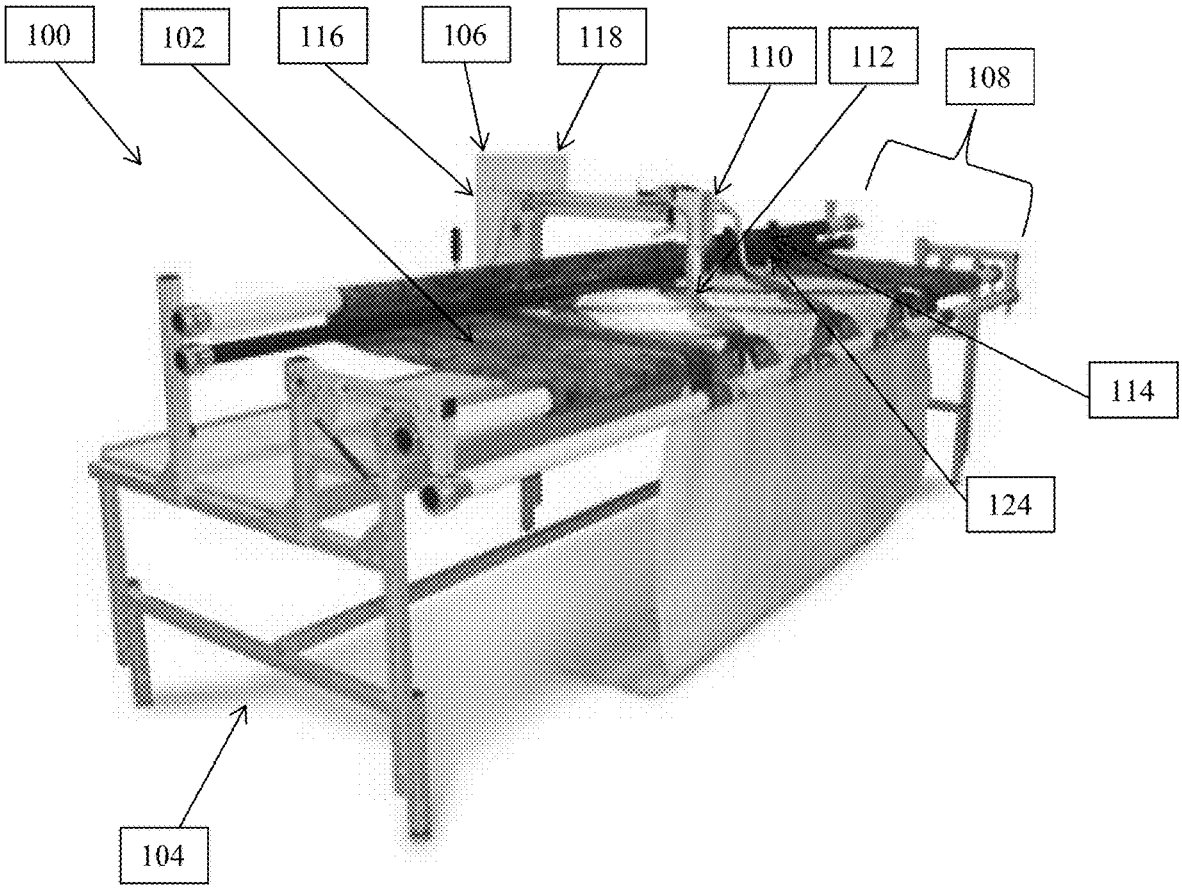
FIG. 1 is a perspective view of an exemplary device suitable for use in practicing exemplary embodiments of this disclosure.

Referring to FIG. 1, shown is a quilting machine 100 for quilting. It should be noted that embodiments of the present disclosure are not limited to the particular configurations of quilting machine 100.

The term quilting machine 100 encompasses any device for stitching or embroidery of a textile or work piece 102. The term includes quilting machines 100 for stitching together multiple layers, such as a filler layer between a top and a bottom textile layer, as well as an embroidery machine.

The term work piece 102 encompasses any article of manufacture or fabric made by weaving, felting, knitting, crocheting, compressing natural or synthetic fibers. In one configuration, the work piece 102 is a quilt.

Quilting machine 100 includes a main frame 104, a sewing machine 106, support frame 108 for supporting or maintaining a work piece, sewing head 110, a reciprocating needle 112, a torque sensor 114, a motor 116, and a controller 118. Controller 118 is operably connected to the sewing head 110 and motor 116. The controller 118 can include a computer processor 120 (not shown) and memory 122 (not shown) for storing computer program instructions. The computer program instructions when executed on the computer processor 120 allow for quilting machine 100 to perform the operations described below.

Controller 118 can also include a display and input device, such as a touch screen, keyboard, keypad, and/or mouse. The controller 118 can be physically connected to the main frame 104 or the sewing machine 106. Alternatively, the controller 118 can be a stand-alone device, which communicates with the sewing machine 106 through a wired or wireless connection.

The support frame 104 can be any variety of configurations, wherein the frame includes struts or supports for engaging components described herein. The frame can be made of any of a variety of materials or combinations such as metals, plastics, composites or wood.

Support frame 104 provides a work piece retention area that retains a work piece 102 or a portion of the work piece 102 relative to the main frame 108 and relative to the sewing machine 106. The support frame 104 can include a supply roll assembly for retaining a rolled portion of work piece 102 and a take up roll assembly for retaining a portion of work piece 102.

Sewing machine 106 includes the sewing head 110, typically having a portion above the plane of the work piece retention area and a second portion below the plane of the work piece retention area, thereby providing for passage of a portion of the reciprocating needle 112 through the work piece 102 and selectively engaging the passage of a length of thread through the work piece 102.

Motor 116 is operably coupled to sewing machine 106, and controlled by controller 118. In another embodiment, motor 116 is also operably coupled to sewing head 110, such as by moving belts, pulleys, and/or chains (substantially in extendable elongate members) for movement in an X-axis, Y-axis or a combination of both directions over a work piece. Motor 116 is able to move sewing machine 106 and/or sewing head 110 in an X-Y direction over the work piece retention area, and at a desired speed over the work piece retention area. In some embodiments, controller 118 is able to automatically direct motor 116 to move sewing machine 106 and/or sewing head 110 in a predetermined manner over the work piece retention area to stitch a predetermined pattern into work piece 102.

In one embodiment motor 116 is also operably coupled to reciprocating needle 112 such that motor 116 is able to move reciprocating needle 112 in an up and down motion to create stitches in a work piece when desired. Embodiments of motor 116 move reciprocating needle 112 in a fashion such that a stitch length is maintained uniform over a work piece regardless of whether movement of the sewing head 110 is accelerating or slowing down. For instance, motor 116 may increase the speed of reciprocating needle 112 as sewing head 110 moves faster over a work piece and the speed of reciprocating needle 112 may decrease as sewing head 110 moves slower over the work piece.

In another exemplary embodiment, quilting machine 100 may include a second motor 117. In this embodiment, motor 116 is not coupled to reciprocating needle 112, and second motor 117 is operably coupled to reciprocating needle 112 for moving reciprocating needle 112 in an up and down motion. Second motor 117 is also operably coupled to controller 118 and is able to increase and decrease the reciprocating speed of reciprocating needle 112 in response to the movement speed of sewing head 110 in order to maintain a uniform stitch length.

Torque sensor 114 is operably connected to sewing head 110, motor 116, and controller 118. Torque sensor 114 is able to sense an applied torque (e.g., a user applied torque) on motor 116 through sewing head 110. For example, when a user begins to move sewing head 110 and/or sewing machine 106 over the work piece retention area, torque sensor 114 senses the torque applied to motor 116 through sewing head 110. Torque sensor 114 is able to sense an applied torque by directly sensing a strain on motor 116 or through a strain gauge or like device by virtue of belts, pulleys, and/or chains attached to sewing head 110 that allow motor 116 to move sewing head 110. As shown in FIG. 1, torque sensor 114 is located on handle or handles 124, however, embodiments of torque sensor 114 can be located anywhere on quilting machine 100 such that an applied torque to motor 116 through force on or movement of sewing head 110 is sensed by torque sensor 114. Torque sensor 114 can include any type of sensor able to sense torque on a system or motor 116 including a strain gauge.

Embodiments of controller 118 are able to, in response to an applied torque on motor 116 sensed by torque sensor 114, communicate and direct motor 116 to move and/or stop and/or change direction of sewing head 110 based on the direction and magnitude of the applied torque sensed by torque sensor 114.

In one embodiment, a user attempts to move sewing head 110 over the work piece retention area by applying a force to handles 124 of sewing head 110 in the direction and with a magnitude of the desired movement. The user applied force is applied through sewing head 110 to motor 116, such as through a linkage, belts, and/or pulleys, and is sensed by torque sensor 114. Torque sensor 114 then communicates the sensed torque to controller 118. Controller 118 then in response to the sensed user applied torque directs motor 116 to move or help move sewing head 110 over the work piece retention area based on the direction and magnitude of the applied torque from the user. In one embodiment, motor 116 moves sewing head 110 in the direction of the applied force and at a speed based on the amount of force applied.

In another embodiment, sewing head 110 or sewing machine 106 may already be in motion over the work piece retention area. In this embodiment, a user may desire to either stop sewing head 110 from moving or may desire to change the direction of movement. In this embodiment, a user may apply a force on handles 124 in a direction opposite to the direction of movement of sewing head 110 or in the desired direction of movement. Again, the user applied force is applied through sewing head 110 through belts for example, to motor 116, and is sensed by torque sensor 114. Torque sensor 114 then communicates the sensed torque to controller 118. Controller 118 then in response to the sensed user applied torque directs motor 116 to move or help move sewing head 110 over the work piece retention area based on the direction and magnitude of the applied torque from the user.

Figure 2:
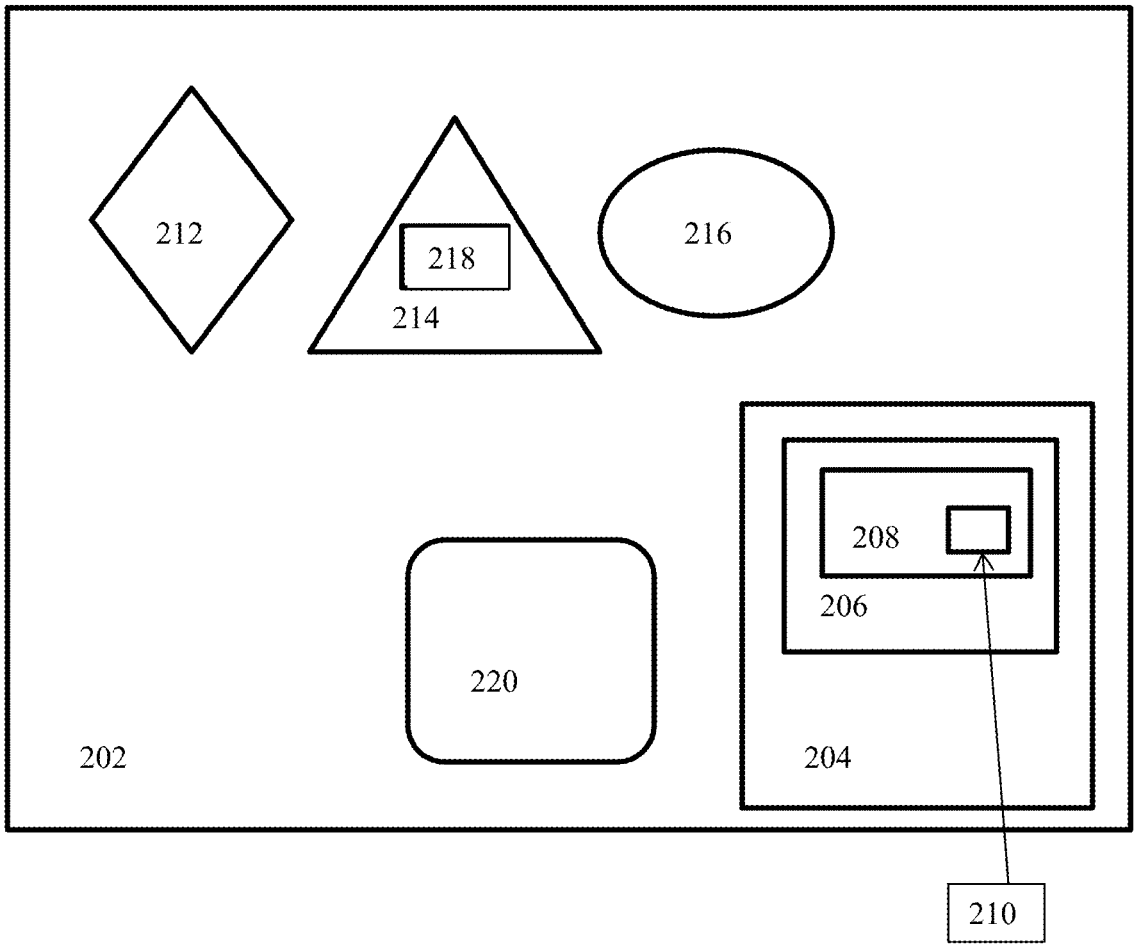
FIG. 2 is a simplified block diagram of a device for use in practicing exemplary embodiments of this disclosure.

Referring to FIG. 2, shown is a simplified block diagram of the various elements of a device suitable for use in practicing exemplary embodiments of this disclosure. In FIG. 2, device 202 is adapted for stitching a work piece. Device 202 may be a quilting or sewing machine, or any device suitable for stitching together two or more pieces of fabric.

Device 202 includes processing means such as controller 204, which includes at least one data processor 206, storing means such as at least one computer-readable memory 208 storing at least one computer program 210. Controller 204, the at least one data processor 206, and the at least one computer-readable memory 208 with the at least one computer program 210 provide a mechanism to interpret and determine user applied torque on a motor 212, and movement of a sewing head 214.

Device 202 includes a sewing head 214 for stitching a work piece and a motor 212 operably connected to the controller 204 and the sewing head 214 such as by belts, pulleys, and/or chains. Controller 204 is able to control the output of motor 212. Motor 212 is able to control the movement of sewing head 214 by activating belts or motorized wheels/rollers over a work piece. Torque sensor 216 is operably connected to sewing head 214 and/or motor 212 such that it can sense user applied torque to motor 212. Torque sensor 216 is also operably connected to controller 204 such that it can communicate its sensed torque information to controller 204.

Device 202 also includes a reciprocating needle 218 operably connected to controller 204 and motor 212. The cycle frequency of reciprocating needle 218 is controlled by motor 212 and in turn determined by controller 204. In another embodiment, motor 212 does not control the cycle frequency of reciprocating needle 218. In this embodiment, device 202 includes a second motor 213 (not shown) that is operably coupled to reciprocating needle 218 for controlling the cycle frequency of reciprocating needle 218. Second motor 213 is able to control the cycle frequency of reciprocating needle 218 such that uniform stitch length is maintained during stitching regardless of whether sewing head 110 moves faster or moves slower.

Device 202 further includes an operational on/off switch 220 for selectively operating controller 204, motor 212, torque sensor 216, and reciprocating needle 218. In some exemplary embodiments, on/off switch 220 is a physical switch located on device 202 that can be operated by hand.

The at least one computer program 210 in device 202 in exemplary embodiments is a set of program instructions that, when executed by the associated data processor 206, enable device 202 to operate in accordance with exemplary embodiments of this disclosure. In these regards, the exemplary embodiments of this disclosure may be implemented at least in part by computer software stored in computer-readable memory 208, which is executable by data processor 206. Devices implementing these aspects of the disclosure need not be the entire device as depicted in FIG. 2, but may be one or more components of same such as the above described tangibly stored software, hardware, and data processor.

Figure 5:
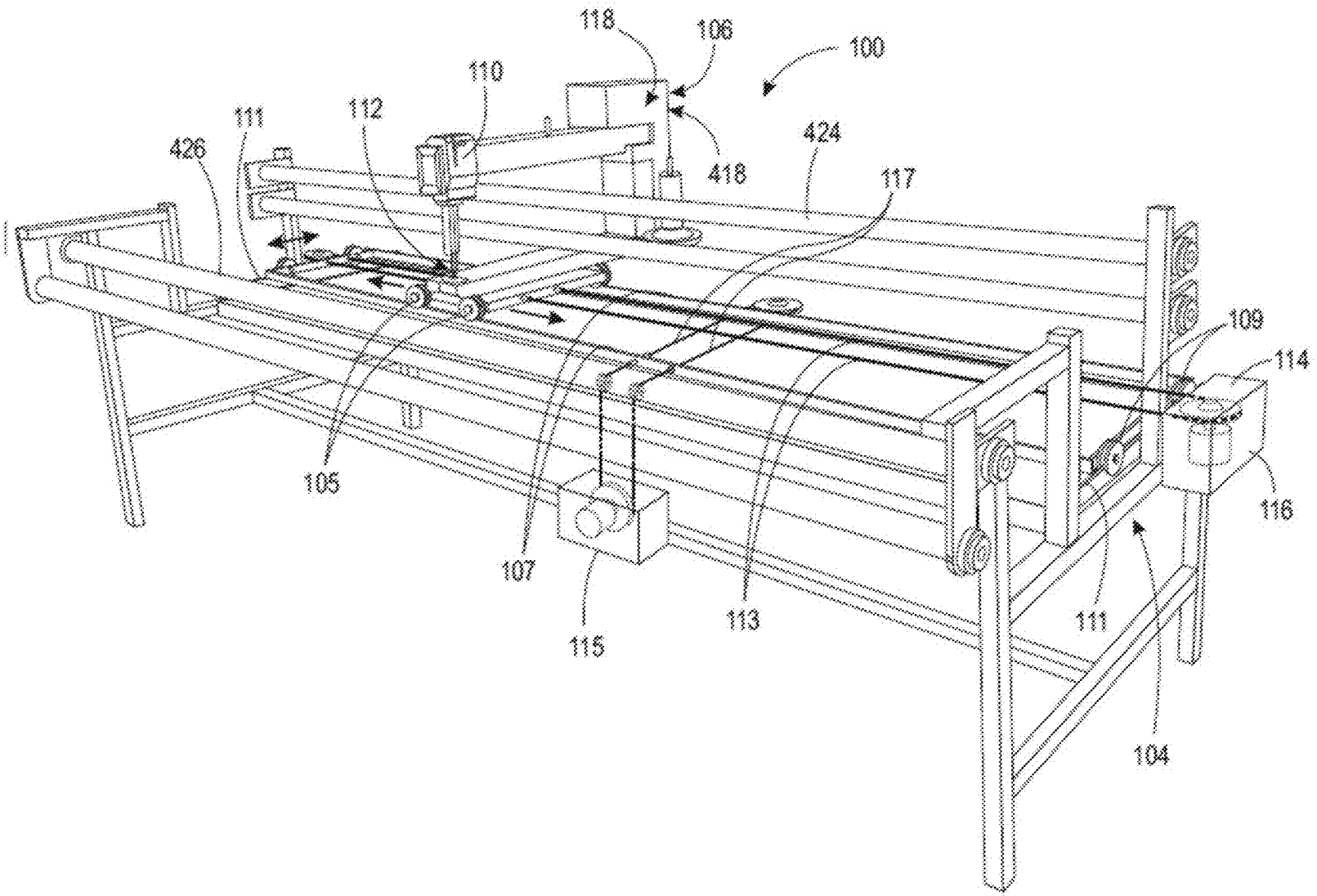
FIG. 5 is a perspective view of an exemplary device suitable for use in practicing exemplary embodiments of this disclosure.

Reference is now made to FIG. 5, which depicts another perspective view of a quilting machine 100 suitable for use in exemplary embodiments of the present disclosure. Shown in FIG. 5 is quilting machine 100 with a main frame 104, a sewing machine 106, a sewing head 110, a reciprocating needle 112, a torque sensor 114, a motor 116, and a controller 118.

As can be seen in FIG. 5, sewing machine 106 is moveably attached to main frame 104 via wheels 105 and rails 107 that allow sewing machine 106 and sewing head 110 to move over the work piece retention area in an X-axis direction. Sewing machine 106 and sewing head 110 is also able to move over the work piece retention area in an Y-axis direction through wheels 109 and rails 111. A user is thus able to freely move sewing head 110 throughout the work piece retention area in both an X-axis and Y-axis manner by the use of wheels 105, 109 and rails 107, 111.

Sewing machine 106 is also moveably coupled to motor 116 through belts 113. Belts 113 with motor 116 are able to move or aid in movement of sewing machine 106 in the X-axis direction. Torque sensor 114 is operably coupled to motor 116 or belts 113 for sensing a torque on motor 116 from sewing head 110. Sewing machine 106 and sewing head 110 is also moveably coupled to motor 115 through belts 117. Belts 117 with motor 117 are able to move or aid in movement of sewing machine in the Y-axis direction. A torque sensor 119 is operably coupled to motor 115 or belts 117 for sensing a torque on motor 115 from sewing head 110.

Figure 3:
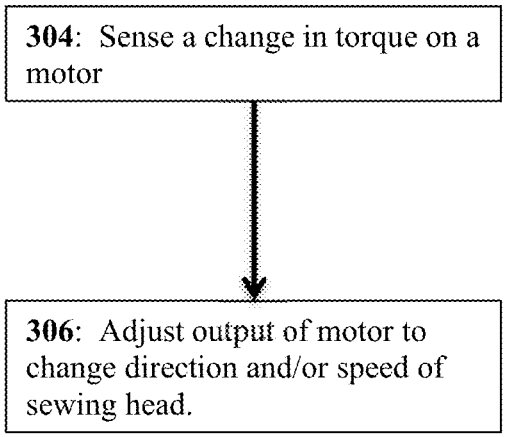
FIG. 3 is a simplified flow diagram in accordance with exemplary embodiments of this disclosure.

Reference is now made to FIG. 3, which depicts a simplified block diagram in accordance with an exemplary method of a quilting or sewing machine. The process begins at block 302 which states that the quilting or sewing machine senses a change in torque. Embodiments of this disclosure include a change of torque on a motor that moves or allows movement of the sewing head. Exemplary changes in torque can occur when the sewing head is stationary and the user applies a torque by physically attempting to move the sewing head. In another embodiment, the sewing head is already in motion over a work piece retention area. In this embodiment, the user applies a torque by physically attempting to change the speed and/or direction of movement of the sewing head. In these embodiments, the torque is on the motor that moves and is coupled to the sewing head, and is sensed by a torque sensor.

Then at block 304 the method continues with adjusting the output of the motor to change movement of the sewing head. Here, the motor responds to the sensed torque by adjusting its output and therefore adjusts the speed and/or direction of movement of the sewing head in proportion to the direction and magnitude of the sensed torque.

Figure 4:
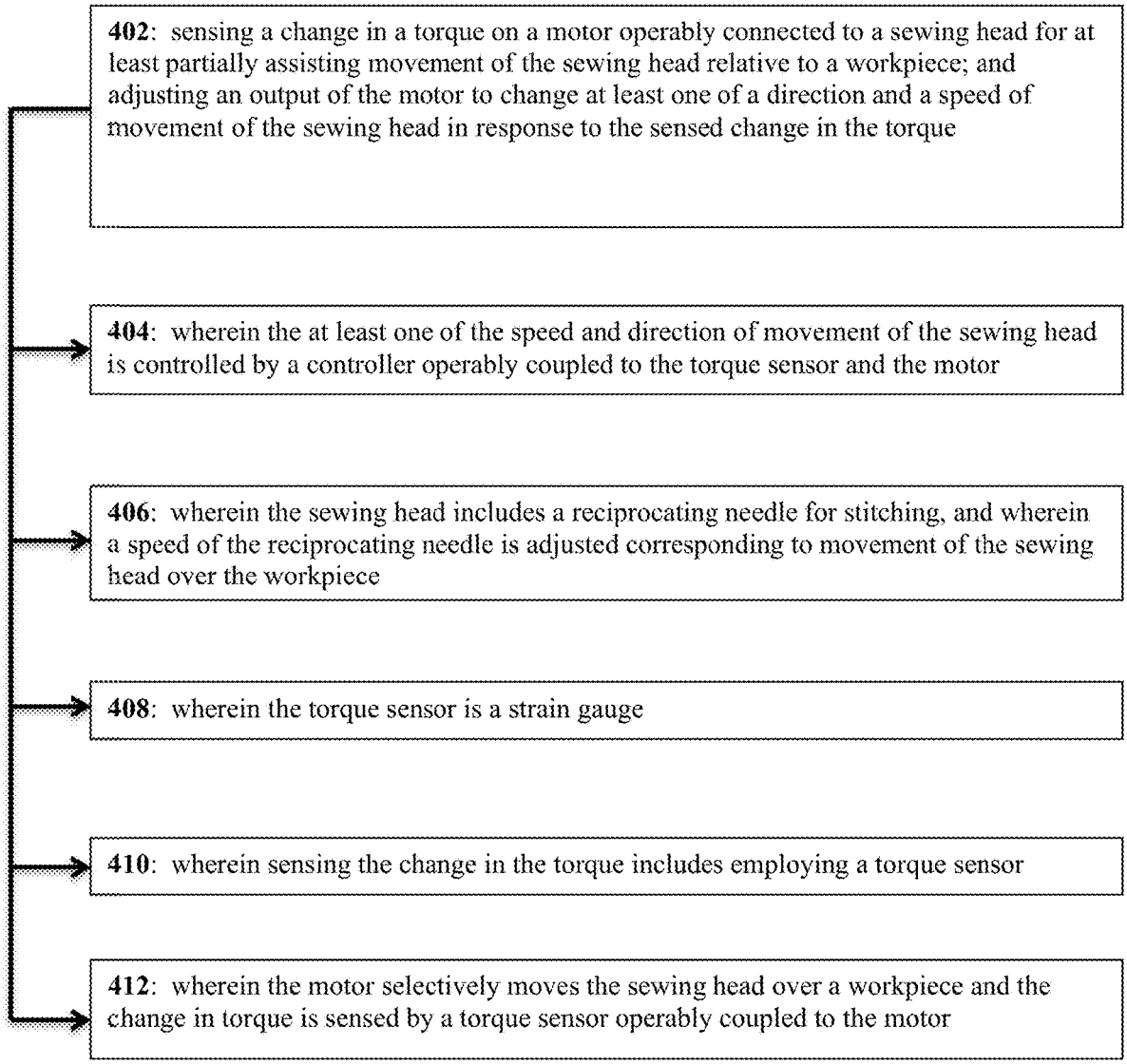
FIG. 4 is a logic flow diagram in accordance with a method, apparatus, and computer-readable medium for performing exemplary embodiments of this disclosure.

FIG. 4 presents a summary of the above teachings. Block 402 presents sensing a change in a torque on a motor operably connected to a sewing head for at least partially assisting movement of the sewing head relative to a workpiece; and adjusting an output of the motor to change at least one of a direction and a speed of movement of the sewing head in response to the sensed change in the torque. Block 404 then specifies wherein the at least one of the speed and direction of movement of the sewing head is controlled by a controller operably coupled to the torque sensor and the motor.

Some of the non-limiting implementations detailed above are also summarized at FIG. 4 following block 404. Block 406 relates to wherein the sewing head includes a reciprocating needle for stitching, and wherein a speed of the reciprocating needle is adjusted corresponding to movement of the sewing head over the workpiece. Block 408 then states wherein the torque sensor is a strain gauge. Block 410 goes on to specify wherein sensing the change in the torque includes employing a torque sensor. Block 412 then states wherein the motor selectively moves the sewing head over a workpiece and the change in torque is sensed by a torque sensor operably coupled to the motor.

The logic diagram on FIG. 4 may be considered to illustrate the operation of a method, a result of execution of computer program instructions stored in a computer-readable medium. The logic diagram of FIG. 4 may also be considered a specific manner in which components of a device are configured to cause that device to operate, whether such device is a quilting machine or some other related device, or one or more components thereof. The various blocks shown in FIG. 4 may also be considered a plurality of coupled logic circuit elements constructed to carry out the associated function(s), or specific result of strings of computer program instructions or code stored in a memory.

Various embodiments of the computer-readable medium include any data storage technology type which is suitable to the local technical environment, including but not limited to semiconductor based memory devices, magnetic memory devices and systems, optical memory devices and systems, fixed memory, removable memory, disc memory, flash memory, dynamic random-access memory (DRAM), static random-access memory (SRAM), electronically erasable programmable read-only memory (EPROM) and the like. Various embodiments of the processor include but are not limited to general purpose computers, special purpose computers, microprocessors, digital signal processors and multi core processors.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A method for stitching, the method comprising:

(a) sensing, by a torque sensor, a change in a user applied torque on a first motor operably connected to a sewing head having a reciprocating needle, the first motor operable for at least partially assisting movement of the sewing head relative to a workpiece, wherein the user applied torque is applied to the sewing head;

(b) adjusting an output of the first motor to change at least one of a direction and a speed of movement of the sewing head in response to the sensed change in the user applied torque; and (c) adjusting an output of a second motor operably connected to the reciprocating needle to adjust a speed of the reciprocating needle in response to a change in a speed of movement of the sewing head relative to the workpiece.

2. The method according to claim 1, wherein the at least one of the speed and direction of movement of the sewing head is controlled by a controller operably coupled to the torque sensor and the motor.

3. The method according to claim 1, wherein the torque sensor, the first motor and the second motor are operably coupled to a controller.

4. The method according to claim 1, wherein the torque sensor is a strain gauge.

5. The method according to claim 1, wherein the motor selectively moves the sewing head over the workpiece.

6. An apparatus for stitching, the apparatus comprising:

(a) a sewing head including a reciprocating needle;

(b) a first motor operably connected to the sewing head, the first motor able to move the sewing head relative to a workpiece;

(c) a second motor operably connected to the reciprocating needle, the second motor operable to move the reciprocating needle;

(c) a torque sensor, the torque sensor able to sense a user applied torque on the motor from the sewing head; and (d) a controller operably coupled to the torque sensor, the first motor and the second motor, the controller able to control at least one of a speed and a direction of the first motor in response to the sensed user applied torque on the motor, the controller able to control a speed of the second motor in response to a change in a speed of movement of the sewing head relative to the workpiece.

7. The apparatus according to claim 6, wherein the controller can increase a speed of the first motor in response to an increase in the sensed torque on the first motor and decrease a speed of the first motor in response to a decrease in the sensed torque on the first motor.

8. The apparatus according to claim 6, wherein the sewing head including the reciprocating needle is for stitching.

9. The apparatus according to claim 6, wherein the torque sensor is a strain gauge.

10. A non-transitory computer-readable medium tangibly comprising computer program instructions which when executed on a processor of an apparatus causes the apparatus to at least:

sense a change in a torque on a motor operably connected to a sewing head for at least partially assisting movement of the sewing head relative to a workpiece, wherein the torque on the motor is applied by a user on at least one handle affixed to the sewing head; and adjusting an output of the motor to change at least one of a direction and a speed of movement of the sewing head in response to the sensed change in the torque applied by the user to the at least one handle.

11. The non-transitory computer-readable medium according to claim 10, wherein a controller can increase a speed of the motor in response to an increase in the sensed torque on the motor and decrease a speed of the motor in response to a decrease in the sensed torque on the motor.

12. The non-transitory computer-readable medium according to claim 10, wherein the sewing head includes a reciprocating needle for stitching, and wherein a speed of the reciprocating needle is adjusted corresponding to movement of the sewing head over the workpiece.

13. The non-transitory computer-readable medium according to claim 10, wherein the torque sensor is a strain gauge.

* * * * *